US006805257B2

(12) United States Patent
Taylor

(10) Patent No.: US 6,805,257 B2
(45) Date of Patent: Oct. 19, 2004

(54) VERSATILE LID SYSTEM

(76) Inventor: Craig V. Taylor, 22502 S. Summit Ridge Cir., Chatsworth, CA (US) 91311

( * ) Notice: Subject to any disclaimer, the term of this patent is extended or adjusted under 35 U.S.C. 154(b) by 0 days.

(21) Appl. No.: 10/159,425

(22) Filed: May 29, 2002

(65) Prior Publication Data

US 2003/0222088 A1 Dec. 4, 2003

(51) Int. Cl.[7] ..... B65D 43/16; B65D 43/24
(52) U.S. Cl. ..... 220/817; 220/832; 220/908
(58) Field of Search ..... 220/817, 818, 220/831, 832, 843, 844, 908, 203, 204, FOR 191; 217/60 C; 16/311, 368, 369, 371; 312/293.2, 319.4, 325

(56) References Cited

U.S. PATENT DOCUMENTS

| | | | | |
|---|---|---|---|---|
| 1,101,521 A | | 6/1914 | Bram | |
| 1,308,563 A | * | 7/1919 | Underwood et al. | 220/263 |
| 1,502,996 A | | 7/1924 | Loetscher | |
| 1,682,552 A | | 8/1928 | Chapel | |
| 1,917,063 A | | 7/1933 | Rollason | |
| 1,923,063 A | | 8/1933 | Bergstrom et al. | |
| 1,986,307 A | * | 1/1935 | Wagner | 217/60 C |
| 2,063,686 A | | 12/1936 | Lefevre | |
| 2,689,370 A | * | 9/1954 | Stone | 16/371 |
| 3,384,385 A | | 5/1968 | Cohen et al. | |
| 3,567,062 A | * | 3/1971 | Reed et al. | 220/832 |
| 3,682,348 A | | 8/1972 | Roberts | |
| 3,951,302 A | | 4/1976 | Owen | |
| 3,989,162 A | | 11/1976 | Hodge et al. | |
| 3,995,764 A | | 12/1976 | Zagami | |
| 4,014,457 A | | 3/1977 | Hodge | |
| 4,098,429 A | | 7/1978 | Hodge | |
| 4,148,411 A | | 4/1979 | Hodge et al. | |
| 4,186,844 A | | 2/1980 | Swanson | |
| RE30,890 E | | 3/1982 | Hodge | |
| 4,320,852 A | | 3/1982 | Nagelkirk | |
| 4,609,117 A | | 9/1986 | Pamment | |
| 4,684,017 A | | 8/1987 | Watanabe et al. | |
| 5,036,997 A | * | 8/1991 | May et al. | 220/832 |
| 5,105,967 A | | 4/1992 | Horpestad | |
| 5,150,806 A | | 9/1992 | Glomski | |
| 5,356,027 A | | 10/1994 | Craft et al. | |
| 5,533,643 A | | 7/1996 | Kruzick | |
| 6,334,542 B1 | | 1/2002 | Hsu | |

FOREIGN PATENT DOCUMENTS

| | | | | |
|---|---|---|---|---|
| GB | 634021 | * | 3/1950 | 220/FOR 191 |

* cited by examiner

*Primary Examiner*—Nathan J. Newhouse
(74) *Attorney, Agent, or Firm*—Fulwider Patton Lee & Utecht, LLP

(57) ABSTRACT

A lid for large size industrial or commercial solid waste containers is mounted to the upper rear edge of the containers by double linkages, with each linkage including two substantially equal length links; and frictional engagement arrangements such as notches or grooves are provided in the lid adjacent the rear thereof for engagement with the upper rear edge of the trash containers, to hold the lid in a partially open configuration. The double linkage also permits the lid to hang down close to the rear of the container, to reduce the front to rear extent of the assembly when the lid is fully open.

3 Claims, 4 Drawing Sheets

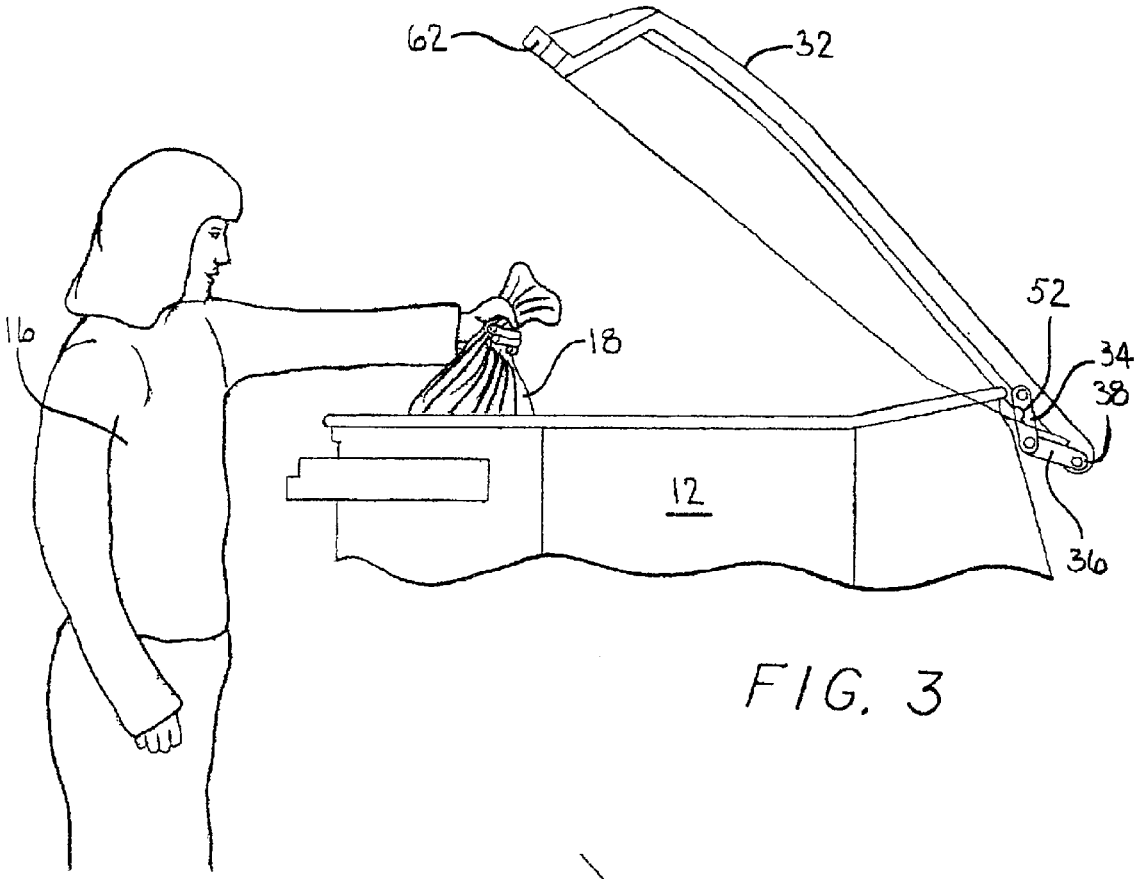
FIG. 3
FIG. 5
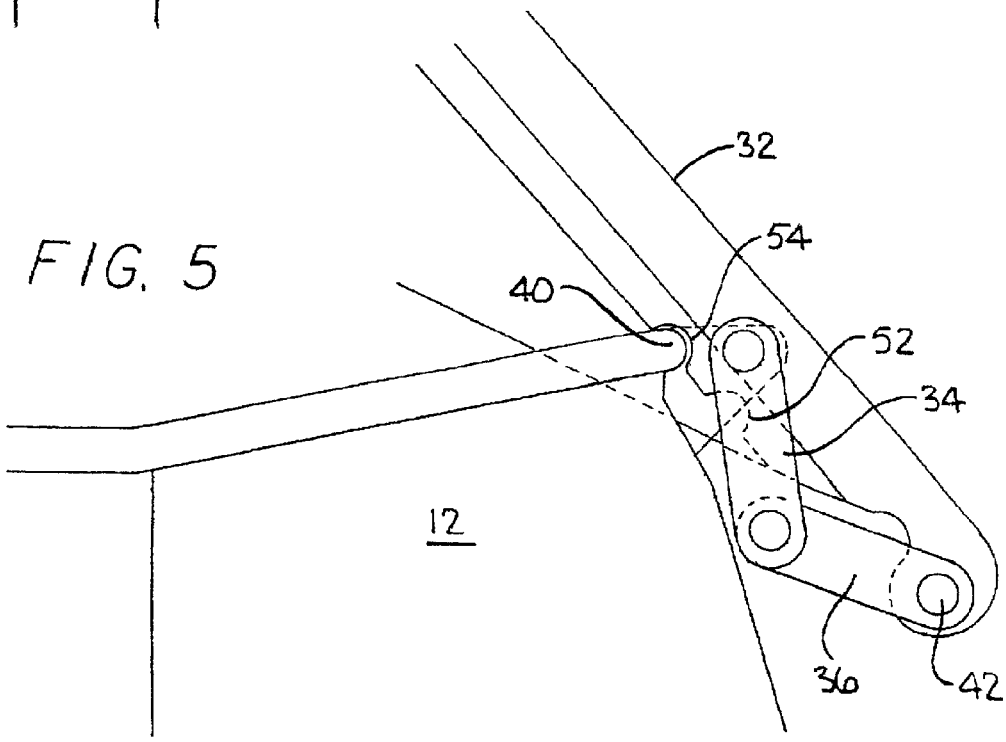

VERSATILE LID SYSTEM

FIELD OF THE INVENTION

This invention relates to lid mounting arrangements for large industrial or commercial solid waste containers.

BACKGROUND OF THE INVENTION

The background of the invention involves the need for simple, sturdy, and reliable arrangements for holding the lid of large waste containers in a partially open configuration. Although there are numerous devices which prop lids open, they are all relatively complex and expensive. Further most of the arrangements which have been proposed heretofore will not survive long in the hostile environment present in the interior of large size waste containers.

Concerning another matter, certain jurisdictions have a requirement that a trash container and lid not occupy more than a predetermined front-to-rear extent, when the lid is fully open. The configuration of many containers and lids is such that the lid when fully opened is angled outward to the rear, so that it occupies more space than is permitted under these regulations.

SUMMARY OF THE INVENTION

Accordingly, one object of the invention is to provide sturdy, reliable and inexpensive, self propping lid for large scale solid waste container.

Another object of the invention is to provide a simple arrangement for reducing the rearward extent of fully opened lids for large solid waste containers.

In accordance with a broad aspect of the invention, both of these objects may be achieved by the use of two double linkages for pivotally mounting the rear edge of the lids to the upper rear edge of a trash container.

In addition, to facilitate the self propping feature, grooves or notches may be provided in the lids to engage the upper rear edge of the trash container, or the associated hinge rod. The lids may then be shifted to the rear, and partially opened so that the grooves or notches will engage the rear of the trash container, so that the lid is held in the partially open configuration.

The grooves or notches are preferably included in a raised or outwardly extending portion on an inside rear area of the lid, with grooves or notches in this raised area extending parallel to the rear edge of the lid and the upper rear edge of the container. These grooves or notches constitute frictional engagement arrangements; and such frictional engagement arrangements may be achieved using roughened surfaces on the lid, using Velcro type hook and loop material or any comparable method.

The lids are preferably provided with two or more grooves or notches to hold the lids at different opening angles; although assemblies with only one groove or notch are fully operable.

The lids are preferably mounted to the rear upper edge of the trash container by the double linkages, one on each side. Each of the two double linkages includes a first link pivotally mounted to the upper rear edge of the trash container, and a second link pivotally coupled both to the first link and also to the rear edge of the lid. The two links of each part of linkages are preferably of substantially the same effective length. Further, the linkages are mounted outside of the rear hinge area thereby entirely avoiding the interior of the container, and the contents thereof which could corrode or foul any mechanism within the container.

With these two double linkages we have the advantages, first of reducing the front-to-rear extent of the assembly because the lid hangs down close to the waste container; and secondly the self propping mode of operation wherein the lid structure and rear edge of the trash container inter-engage either by grooves, notches or other frictional engagement. Another advantage of the present invention is that the lid and linkage assemblies may be readily retrofitted onto existing trash containers.

Other objects features and advantages will become apparent from a consideration of the following detailed description, and from the accompanying drawings.

BRIEF DESCRIPTION OF THE DRAWINGS

FIG. 3 is a partial cross-sectional view of the trash container and lid of FIG. 2, with the lid relatively wide open;

FIG. 5 is an enlarged side view of a portion of the trash bin and lid assembly showing the lid with a recess engaging the back end of the trash container in a notch or groove formed on the lid;

DETAILED DESCRIPTION OF THE PREFERRED EMBODIMENTS

While the specification describes particular embodiments of the present invention, those of ordinary skill can devise variations of the present invention without departing from the inventive concept.

Figure 1:
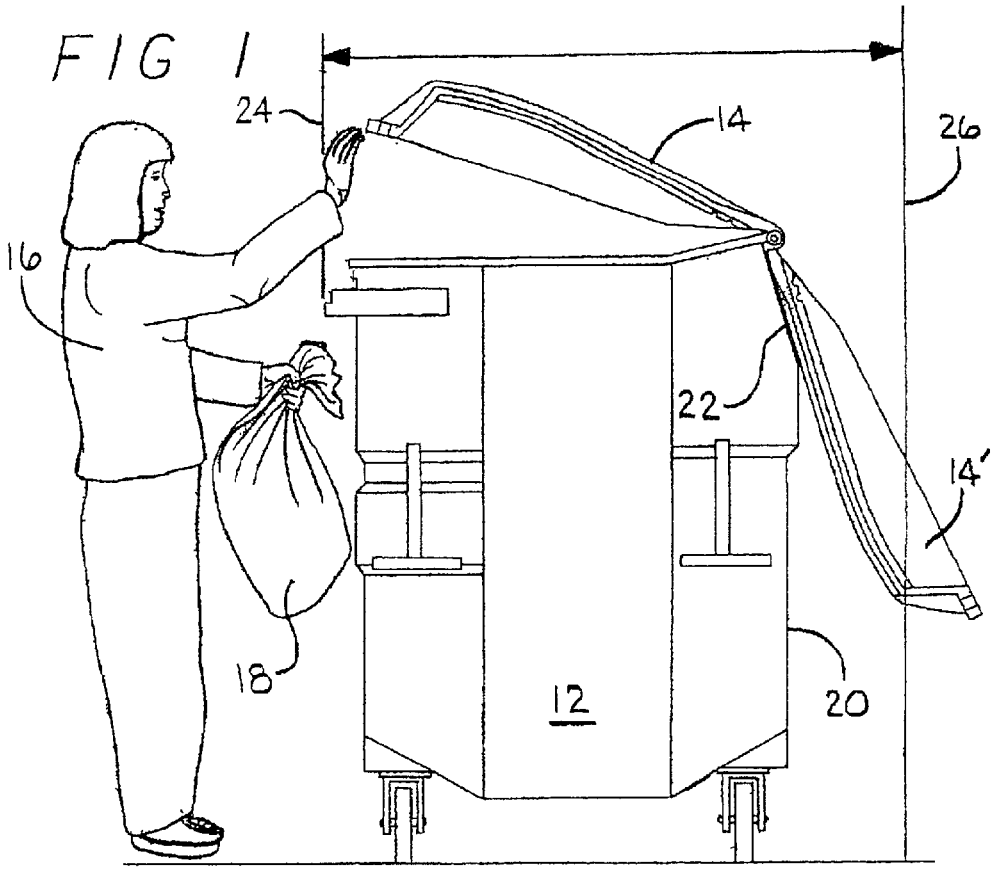
FIG. 1 is a schematic showing of the deposit of trash into a large industrial trash container, with two positions of the lid being shown, in this prior art construction.

Referring now to FIG. 1 of the drawings, a prior art trash container 12 and lid 14 is shown. Lid 14 is shown in the partially open state with the user 16 using one hand to raise the lid and the other hand to insert a large bag of trash 18 into the container. The lid 14, is shown both in the partially open position using the reference numeral 14, and with the lid 14' constituting a showing of the lid in the fully open condition.

It may be noted that the trash container 12 has a rear wall including a lower vertical portion 20, and an upper portion 22 which is slanted to the front, when the container is viewed from below. This forward slanting portion of the wall 22, directs the lid 14' a significant distance outwardly to the rear, when the lid 14' is in the fully open position.

In the showing of FIG. 1, vertical lines 24 and 26 are provided to indicate a maximum allowable front-to-rear extent of the container and lid, when the lid is in the fully open condition, in accordance with regulations or standards established by certain jurisdictions. As indicated in FIG. 1, the allowable distance in some cases has been established as 1250 mm, or 125 cm, corresponding to about 49.2 inches, or about 4 feet and 1.2 inches.

As indicated in FIG. 1, conventional lids with conventional mounting arrangements at the upper rear edge of the solid waste container, do not meet these regulations.

Figure 2:
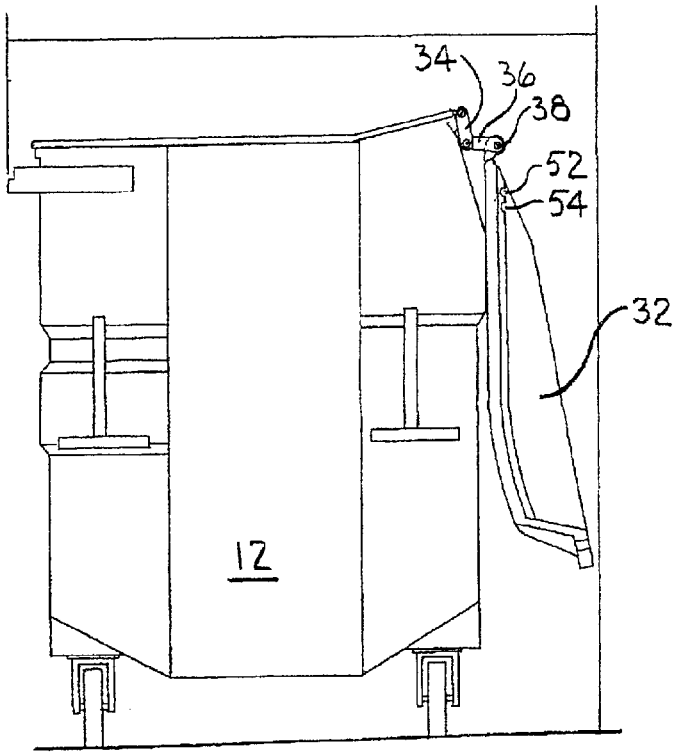
FIG. 2 is a side view of a lid and trash container assembly implying a double linkage illustrating the principles of the invention.

Referring now to FIG. 2 of the drawings, the trash container 12 is provided with a lid 32 which is mounted to the upper rear edge of the trash container 12 by double linkages including a link 34 which is pivoted to the upper rear edge of the trash container, and a second linkage 36 which is pivoted at one end to the first linkage 34, and at the other end to the pivot rod 38 which extends across the rear of the lid 32.

Figure 7:
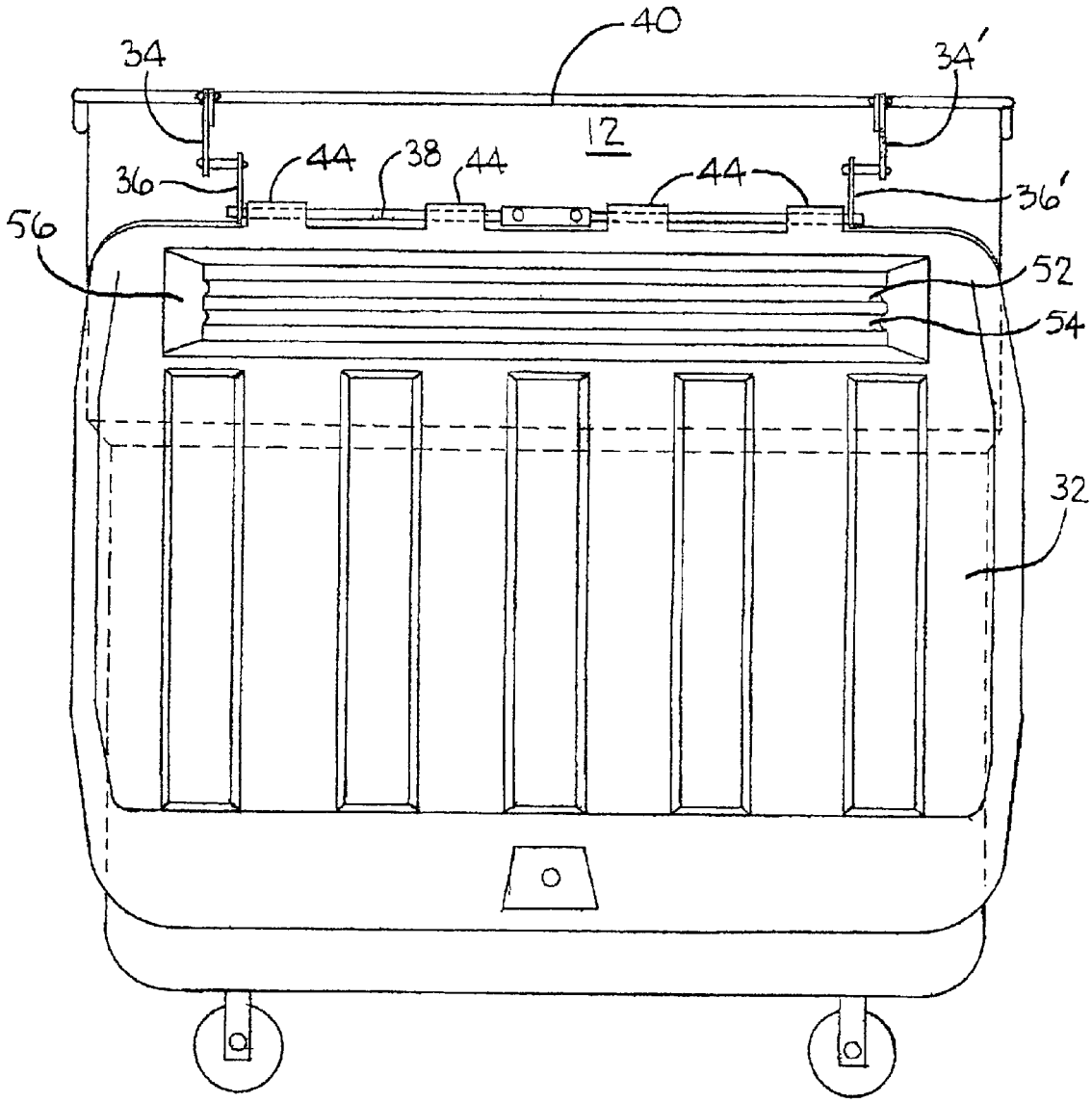
FIG. 7 is a rear view of the lid hanging down to the rear of the trash container and with the rear and interior of the lid being shown in this view.

For completeness, while discussing the mounting arrangements for the lid 32, reference will be made to FIG. 7. In FIG. 7, the two double linkages 34, 36 and 34', 36' are shown mounted both to the upper rear edge 40 of the trash container, and also to the pivot rod 38 which extends through the lugs 44 at the rear edge of the lid 32.

As shown in FIG. 2 of the drawings, the lid and solid waste container, with the double linkages, clearly are within the front-to-rear space limitations mentioned hereinabove.

In FIG. 2 and of the drawings, attention is now directed to the two grooves or notches 52 and 54 which are formed in a raised portion 56 on the inner surface of the lid 32.

Figure 4:
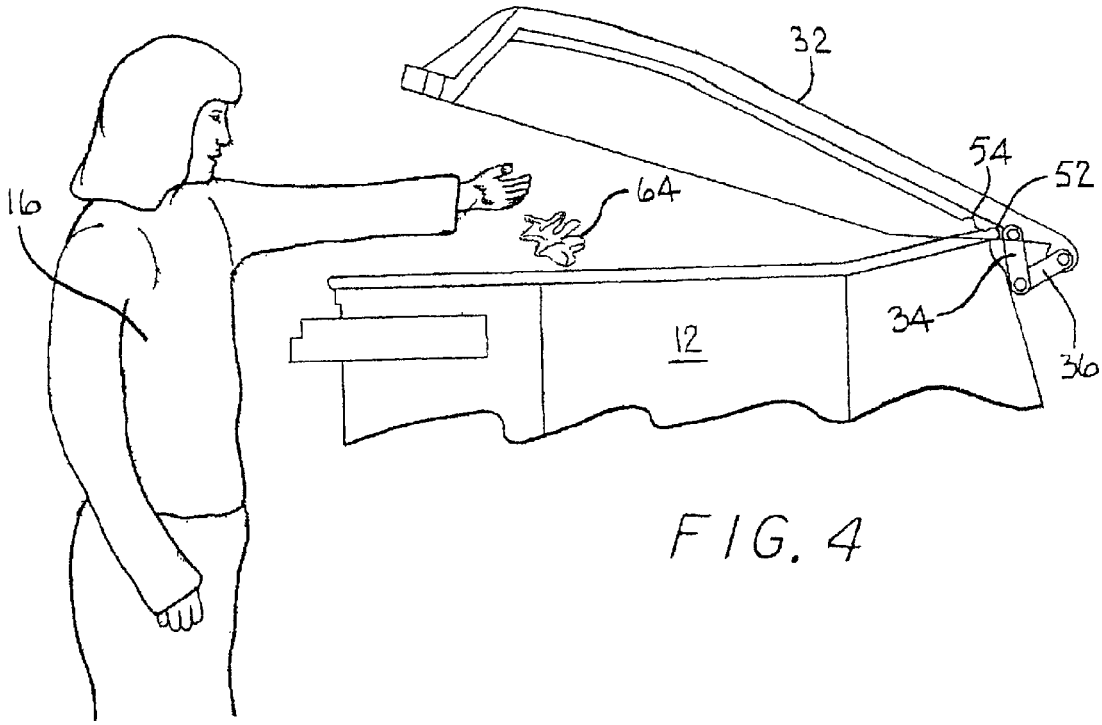
FIG. 4 is a view similar to that of FIG. 3, but with the lid open at a smaller angle.

Referring now to FIGS. 3 and 4 of the drawings, these figures show two stable partially open configurations of the lid 32.

Initially attention will be directed to FIGS. 3 and 5 of the drawings relating to the mode of operation of the assembly when the user 16 wishes to deposit a fairly large bundle 18 of solid waste material into the trash container 12, and wants to have the lid 32 at a fairly wide partially open stable position. As best shown in FIG. 5 of the drawings, which relates to FIG. 3, the user pushes the lid to the rear and up to a fairly high level, so that the groove 54 in the lid 32 engages the rear edge 40 of the trash container. Following the deposit of trash, the user 16 grips the front edge 62 of the lid 32 and pulls it forward and upward, so that it will return to the closed configuration.

Figure 6:
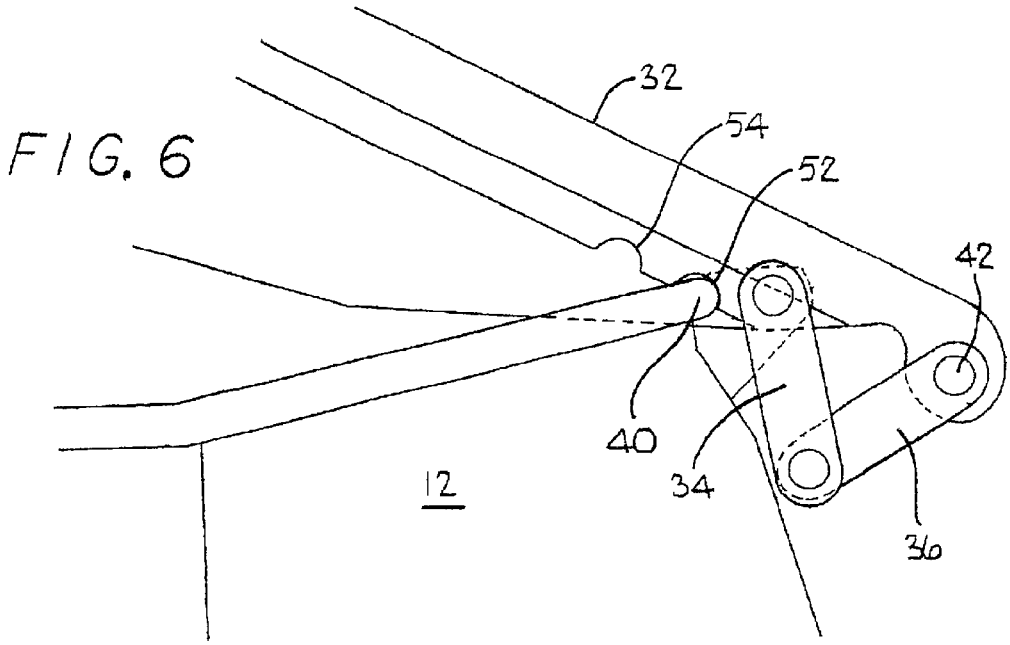
FIG. 6 is a showing similar to that of FIG. 5, but with the lid and rear edge of the trash container engaging in another notch in the lid construction to provide a different opening angle.

Referring now to FIGS. 4 and 6 of the drawings, if the user 16 only wants to deposit a small package of trash 64 into the solid waste container 12, the lid 32 is only raised to a lower level while it is being pushed back, and the groove 52 then engages the rear edge of the trash container 40 and the lid then assumes the partially open state as shown in FIGS. 4 and 6 of the drawings with the lid only having a relatively small available opening for the deposit for the small package of trash 64.

Accordingly, with the double linkage 34, 36, as shown in FIGS. 2–7 of the drawings, the desirable features of reduced front-to-rear extent, and simple and reliable partial opening in a stable condition, are both achieved.

Concerning dimensions, it is desirable that the linkage 34 be substantially equal in length to the linkage 36, and in one embodiment, the center-to-center distance of each line was 3½ inches. However, it is to be understood that somewhat longer or shorter links may be used for different size containers, with the linkages being short enough so that the lid does not touch the ground when fully open. It is also noted that the linkage 34 could be located a slight distance down the back of container 12, and the linkage 34 might then be slightly shorter than the link 36. The lid in one embodiment was about 49½ inches wide and 37 inches from the center of the pivot openings to the front of the lid. The capacity of the containers in one illustrative embodiment of the invention was greater than a cubic yard, and it is to be understood that the invention is applicable to much bigger containers and to those with two lids, for examples.

In the foregoing detailed description, one specific illustrative embodiment of the invention has been shown in the drawings and described in detail in the specification. It is to be understood, however, that various changes and modifications may be made without departing from the spirit and scope of the invention. By way of example and not of limitation, instead of two grooves or notches, the assembly may include only one groove or notch, or could include more than two notches or grooves. In addition, the grooves or notches do not have to be continuous as shown in FIG. 7 but may be discrete, with one section on the left hand side of the lid as shown in FIG. 7 and the other section being the right hand side of the lid as shown in FIG. 7. Further, instead of a plurality of grooves the raised portion 56 on the lid as shown in FIG. 7 could have frictional surfaces akin to coarse sandpaper or Velcro type hook and loop material with mating frictional material on the upper rear edge of the container. It is also noted in passing that the preferred material employed in the fabrication of the lid is polyethylene, but other known plastics may be employed. In addition, the lid may be formed of a single wall or a double wall of plastic or may be formed with a strengthening box channel configuration around its outer perimeter. Accordingly, the present invention is not limited to the construction precisely as shown and described hereinabove.

We claim:

1. A versatile lid assembly for industrial or commercial solid waste containers comprising:

a large size trash container with an upper rear edge;

a lid for closing said trash container, said lid having front and rear edges, and two sides;

said lid being pivotally mounted to said container by two spaced double linkages, one of said double linkages being mounted to said lid at one side thereof, and the other of said double linkages being mounted at the other side of said lid;

each of said double linkages including a first link pivotally mounted to the said rear edge of said trash container, and a second link pivotally mounted to the rear edge of said lid, with said two links being pivotally coupled together; whereby said lid may be folded back to hang close to the rear of said trash container;

said lid further including a raised area on the inside of said lid toward the rear thereof;

said raised area having at least two grooves or notches therein, said grooves extending substantially parallel to the rear edge of said lid and said container;

said grooves or notches being formed to engage the upper rear edge of said trash container, to hold said lid open at a desired opening angle, as determined by the location of said grooves.

2. A versatile lid assembly as defined in claim 1 wherein said trash container has a capacity of at least one cubic yard.

3. A versatile lid assembly as defined in claim 1 wherein said second link is mounted on a hinge rod which extends along the rear edge of said lid.

* * * * *